US011318360B2

(12) United States Patent
Miller

(10) Patent No.: US 11,318,360 B2
(45) Date of Patent: May 3, 2022

(54) INTERCHANGEABLE GOLF CLUB GRIP

(71) Applicant: QUIK GRIP, LLC, Melbourne, FL (US)

(72) Inventor: Glenn Miller, Melbourne, FL (US)

(73) Assignee: QUIK GRIP, LLC, Melbourne, FL (US)

( * ) Notice: Subject to any disclaimer, the term of this patent is extended or adjusted under 35 U.S.C. 154(b) by 0 days.

(21) Appl. No.: 17/313,756

(22) Filed: May 6, 2021

(65) Prior Publication Data

US 2021/0346772 A1 Nov. 11, 2021

Related U.S. Application Data

(60) Provisional application No. 63/020,929, filed on May 6, 2020.

(51) Int. Cl.
*A63B 60/14* (2015.01)
*A63B 60/08* (2015.01)
*A63B 53/14* (2015.01)

(52) U.S. Cl.
CPC ..... *A63B 60/14* (2015.10); *A63B 53/14* (2013.01); *A63B 60/08* (2015.10)

(58) Field of Classification Search
CPC ..... A63B 60/14; A63B 53/14; A63B 60/08
See application file for complete search history.

(56) References Cited

U.S. PATENT DOCUMENTS

| | | | | |
|---|---|---|---|---|
| 4,671,511 | A * | 6/1987 | Trysinsky | A63B 49/035 473/552 |
| 5,730,662 | A * | 3/1998 | Rens | A63B 60/08 473/549 |
| 2008/0227562 | A1* | 9/2008 | Gill | A63B 53/14 473/282 |
| 2012/0129624 | A1* | 5/2012 | Ito | A63B 53/14 473/303 |
| 2013/0196769 | A1* | 8/2013 | Shocklee | A63B 15/00 463/37 |
| 2016/0175669 | A1* | 6/2016 | Sin | A63B 60/12 473/206 |

* cited by examiner

*Primary Examiner* — Jeffrey S Vanderveen
(74) *Attorney, Agent, or Firm* — Mark C. Johnson; Johnson Dalal

(57) ABSTRACT

An interchangeable golf club grip assembly is disclosed that includes a cylindrical inner sleeve member and an outer sleeve member, wherein the inner sleeve member is configured to couple and fasten with a shaft of a golf club and includes a threaded aperture and a plurality of alignment and retention ribs thereon. The outer sleeve member is disposed over the inner sleeve member in a retained configuration using the plurality of ribs and also includes a threaded aperture. The inner and outer sleeve member are fastened together with a fastener that prevents longitudinal movement of the outer sleeve member with respect to the inner sleeve member.

14 Claims, 9 Drawing Sheets

INTERCHANGEABLE GOLF CLUB GRIP

FIELD OF THE INVENTION

The present invention relates generally to golf club grips and, more particularly, relates to interchangeable golf club grips.

BACKGROUND OF THE INVENTION

The game of golf is played by a significant amount of people across the world. Golf is a club-and-ball sport in which players use various clubs to hit balls into a series of holes on a course in as few strokes as possible. Golf clubs are used to hit the golf ball and each club is composed of a shaft with a lance (or "grip") on the top end and a club head on the bottom. Long clubs, which have a lower amount of degree loft, are those meant to propel the ball a comparatively longer distance, and short clubs a higher degree of loft and a comparatively shorter distance. The actual physical length of each club is longer or shorter, depending on the distance the club is intended to propel the ball. The grip on the club is the part on the club most prone to degradation and damage based on the material used to create the grip, e.g., a rubber or synthetic rubber material, and the amount and degree of contact the grip receives by the user.

When the grip is damaged, it can also injury or damage to a user's hands or a glove, respectively. When the grip is damaged, the club head is typically not damaged, functional, and effective. Most users, however, do not have the time to have the grip replaced. Moreover, to have the grip replaced, the cost to replace said grip is typically high when compared the cost to replace the entire club. Additionally, many users desire to change the color or texture of the golf grip in an effective, efficient, and safe manner.

Some known devices and products are designed to protect the golf grip by sliding a piece of material or cover over the outer surface of the original golf grip, wherein the cover is typically of the same material of the original golf grip. However, those known device and products are prone to loosening after installation and/or dislodging when used by the user while swinging.

Therefore, a need exists to overcome the problems with the prior art as discussed above.

SUMMARY OF THE INVENTION

The invention provides an interchangeable golf club grip that overcomes the hereinafore-mentioned disadvantages of the heretofore-known devices and methods of this general type and that effectively, efficiently, and safely enables users to change their golf club grips.

With the foregoing and other objects in view, there is provided, in accordance with the invention, a [claim 1]

In accordance with another feature, an embodiment of the present invention includes . . . .

In accordance with a further feature of the present invention, . . . .

Although the invention is illustrated and described herein as embodied in a interchangeable golf club grip assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the inner or outer sleeve member or spanning to and from the first and second ends disposed thereon.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF INVENTION

Figure 1:
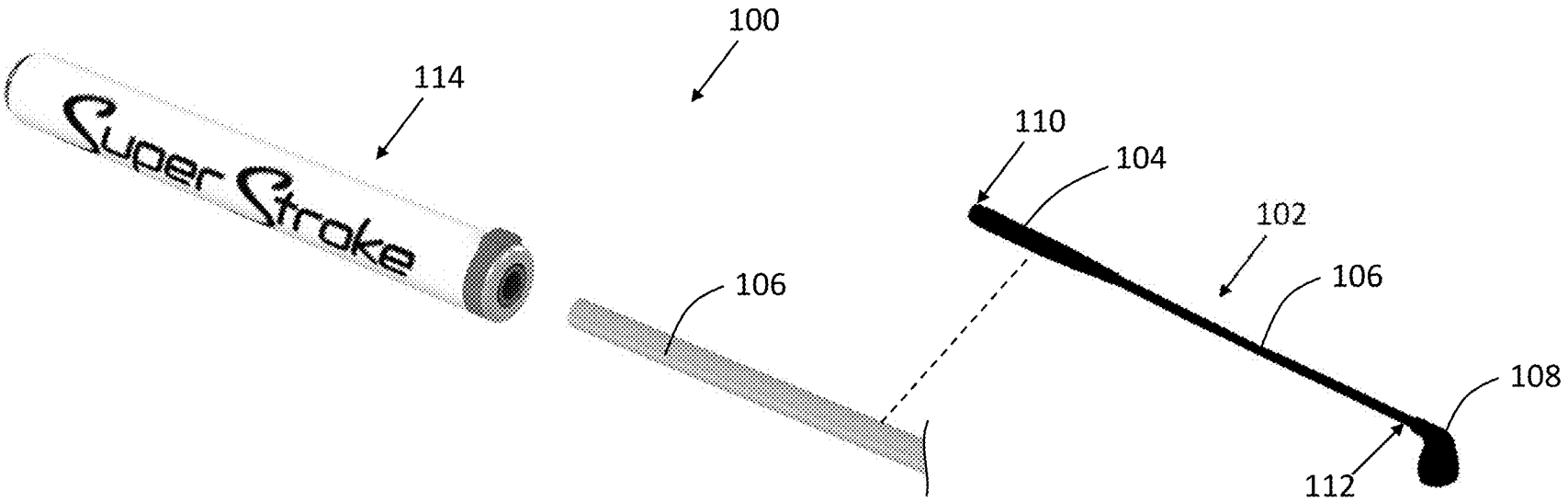
FIG. 1 is a perspective and fragmentary view of an interchangeable golf club grip assembly couplable to a golf club, namely a shaft of a golf club, in accordance with one embodiment of the present invention.
Figure 2:
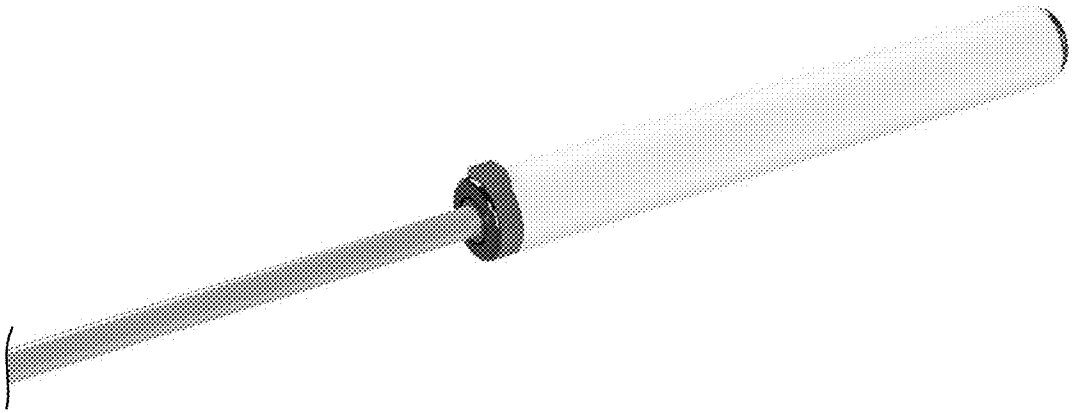
FIG. 2 is a perspective view of the interchangeable golf club grip assembly in FIG. 1 coupled to a shaft of a golf club in accordance with one embodiment of the present invention.
Figure 3:
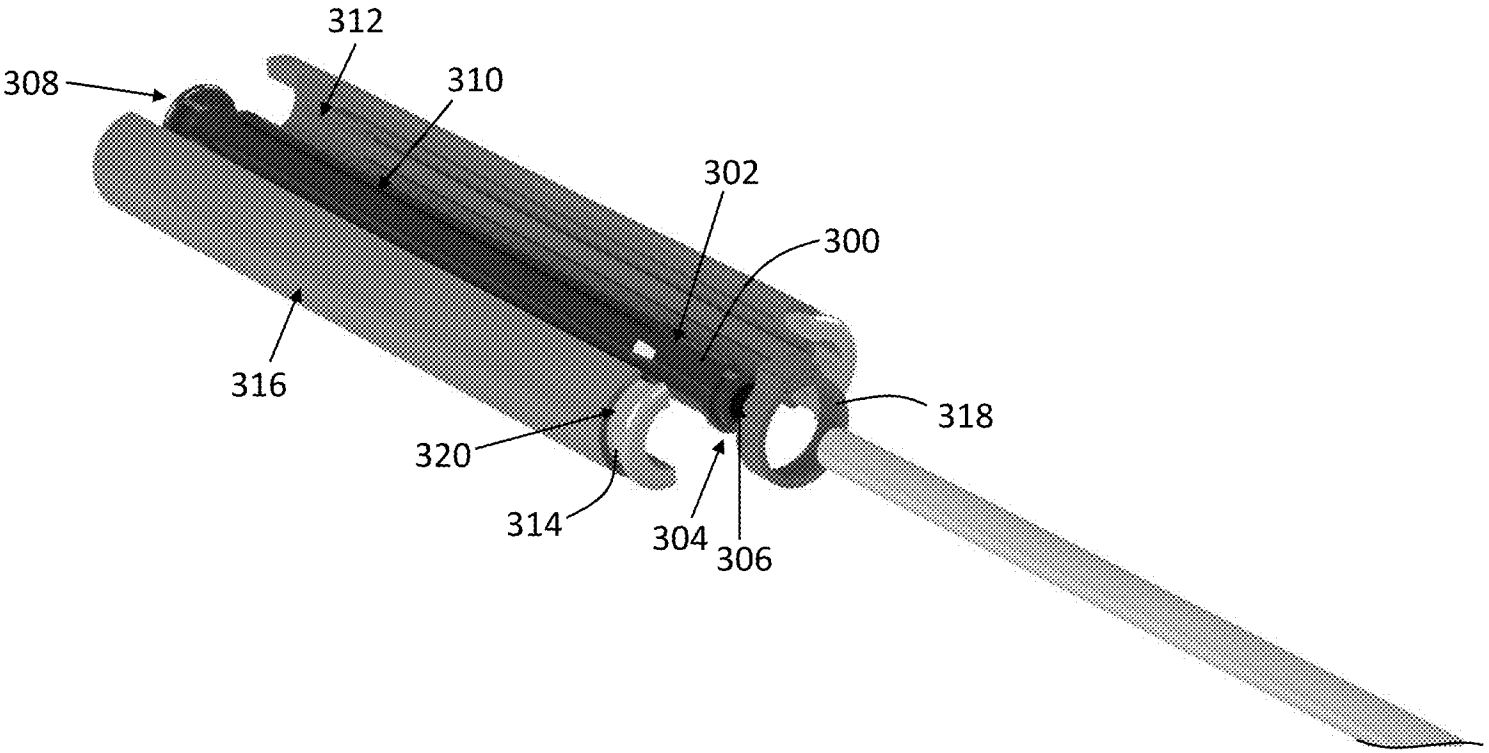
FIG. 3 is an exploded view of the interchangeable golf club grip assembly in FIG. 1 couplable to a shaft of a golf club in accordance with one embodiment of the present invention.
Figure 4:
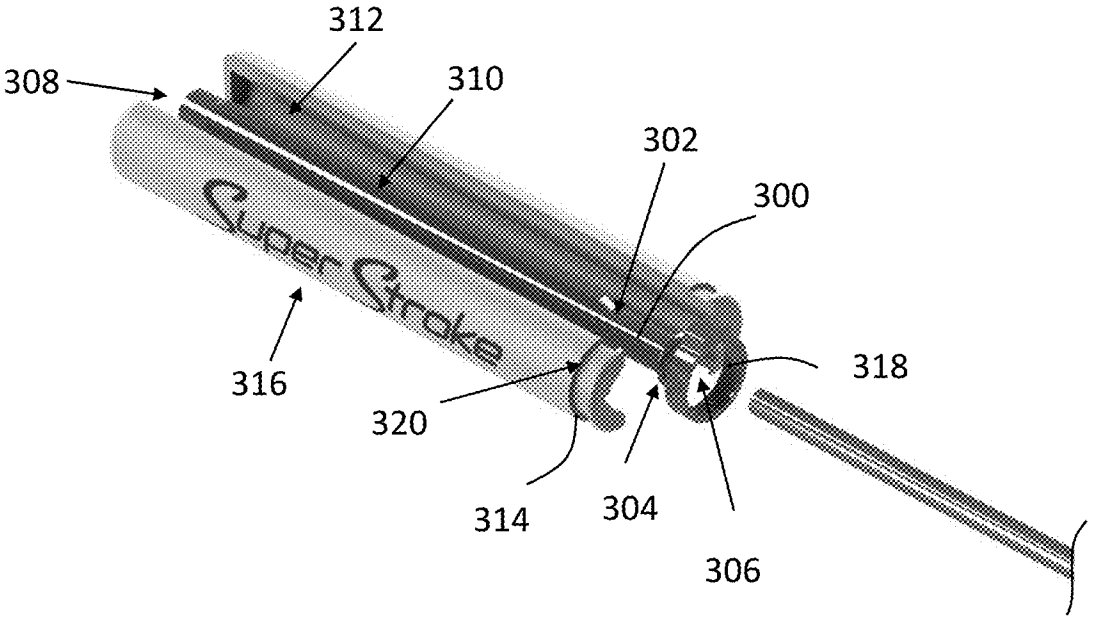
FIG. 4 is an exploded view of the interchangeable golf club grip assembly in FIG. 1 couplable to a shaft of a golf club in accordance with one embodiment of the present invention.
Figure 5:
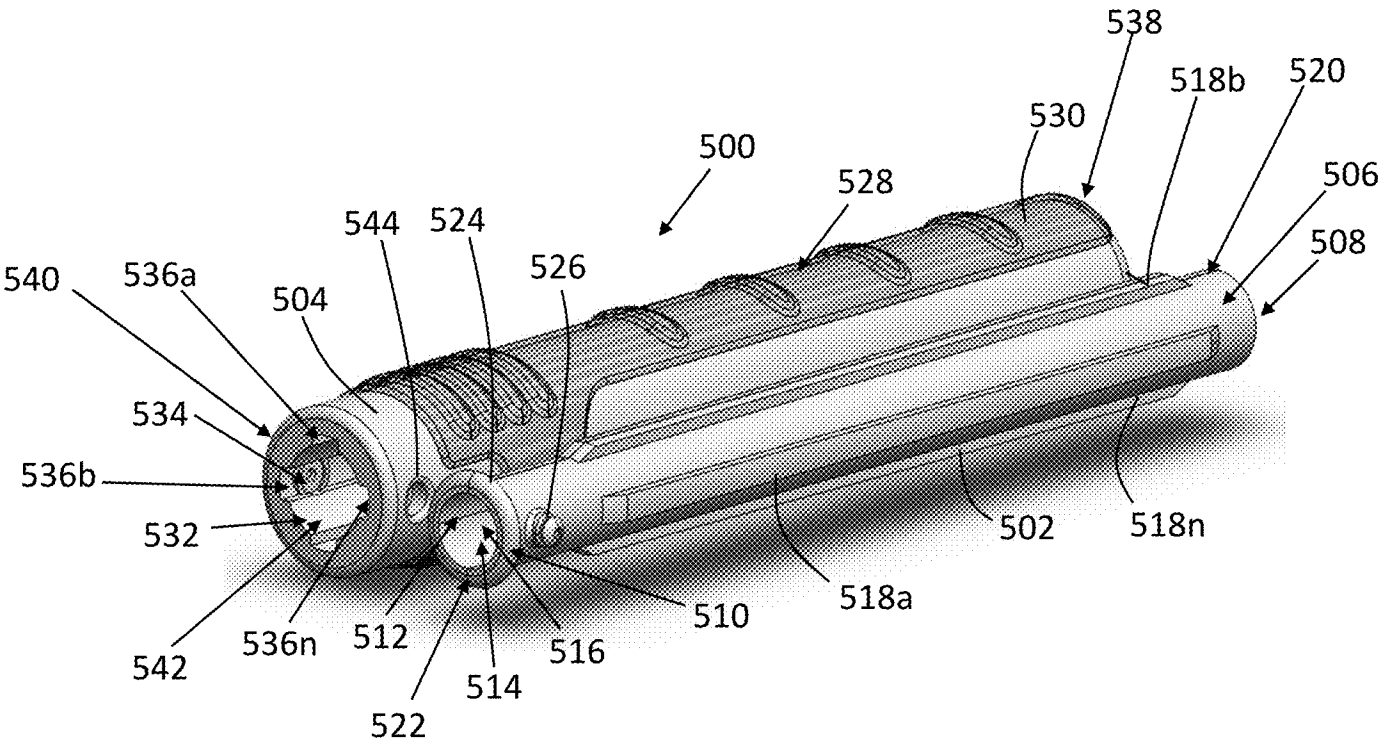
FIG. 5 is a perspective view of the interchangeable golf club grip assembly, namely an inner sleeve member and an outer sleeve member, in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient interchangeable golf club grip assembly that enables different grips to be changed effectively and efficiently. Referring now to FIGS. 1-4, one embodiment of the present invention is shown in various views. FIGS. 1-4 show several advantageous features of the present invention, but, as will be described below, the invention can be provided in several shapes, sizes, combinations of features and components, and varying numbers and functions of the components. The first example of an interchangeable golf club grip 100 is described in combination with a conventional golf club 102 with a golf club grip 104, i.e., a conventional club having a grip (with a deformable material) attached to a shaft of the club, whereby the grip portion 104 is removed thereby exposing the shaft 106 (which is typically of a substantially rigid metallic material). The interchangeable golf club grip 100 includes an interchangeable grip assembly 114. The interchangeable grip 114 assembly enables users to effectively cover and/or encapsulate the conventional grip portion 104 on the shaft 106 of the golf club 102 as described herein. Other embodiments of the present invention are depicted in FIGS. 5-10 and depict the interchangeable grip assembly 500 having many of the same features and having the same functional benefit.

More specifically, the interchangeable grip 104 assembly may a sleeve 300 with an outer surface 302, with a first end 304 defining a first end opening 306, with a second end 308 opposing the first end 304 of the sleeve. The sleeve 300 may also include a sleeve length separating the first and second ends of the sleeve and an inner surface defining an inner channel substantially spanning (i.e., at least 75%, but preferably at least 95%) the sleeve length from the first end opening. The inner channel and opening 306 of the sleeve are shaped and sized to receive the either (or both) the deformable grip and the shaft. Said another way, the deformable grip and the shaft may be disposed within the inner channel and opening 306. In one embodiment, the inner channel and opening 306 are shaped and sized to be slightly smaller than or equal to the diameter of the deformable grip and the shaft of the golf club so that it is snugly retained therein. In one embodiment, the material of the sleeve may be flexible and/or elastic to provide elastic deformation of the sleeve without plastically deforming the sleeve. In one embodiment, the deformable grip and/or the shaft are retained by the inner surface of the sleeve frictionally, e.g., using a friction-inducing material, such as natural rubber. In other embodiments, the deformable grip and/or the shaft are retained by the inner surface of the sleeve using adhesive, fastener(s), or a combination of the above.

The outer surface 310 of the sleeve can also be seen having a plurality of longitudinally oriented ridges and valleys circumferentially disposed and defined thereon and operably configured to mate with and/or couple to a corresponding plurality of longitudinally oriented ridges and valleys circumferentially disposed and defined on an inner surface 312 of an outer sleeve member 314, thus preventing rotational movement thereon. Said another way, the inner surface of the outer sleeve member 314 may be selectively removably coupled to the outer surface of the sleeve 300 with a male-female interlocking configuration to prevent rotational movement thereon The outer sleeve member 314 may be composed of two shell pieces operably configured to join, mate, couple, and/or fasten together. In other embodiments, the outer sleeve member 314 may be of a single piece of material. The outer sleeve member 314 may also include an outer surface 316 of a deformable material and circumferentially disposed thereon (e.g., the same deformable material conventionally found on golf club grips). The interchangeable grip assembly is thus sized and configured to leave close tolerances and does not interfere with grip size or feel of the conventional golf club grip. In one embodiment, the maximum cross-sectional dimension of the interchangeable grip assembly is approximately 1 inch and a maximum length (or sleeve length) of approximately 2 inches. The distal end 308 of the assembly is also preferably at least approximately 2 inches from the tip end of the conventional golf club grip.

The interchangeable golf club grip may also beneficially include an annular shaped fastener 318 (e.g., zip tie, Velcro strap, etc.) selectively removably coupled to the outer surface of the outer sleeve member and compressively retaining the interchangeable grip to the deformable grip of the golf club. In one embodiment, the interchangeable golf club grip may utilize a plurality of annular shaped fasteners to retain the outer sleeve member to the sleeve and club. The outer surface of the outer sleeve member may also define one or more annular shaped channels 320 sized to receive the annular shaped fastener(s). The annular shaped channels 320 may be flanked by portions of the outer surface of the outer sleeve member as well. The annular shaped fastener provides compressive force on the outer sleeve member and/or sleeve, thereby preventing longitudinal movement of the same relative to the golf club grip as well. As such, to replace a grip of the golf club the user will only need to selectively remove the fastener 318 and outer sleeve member, and add another new outer sleeve member and fastener on the sleeve.

Figure 10:
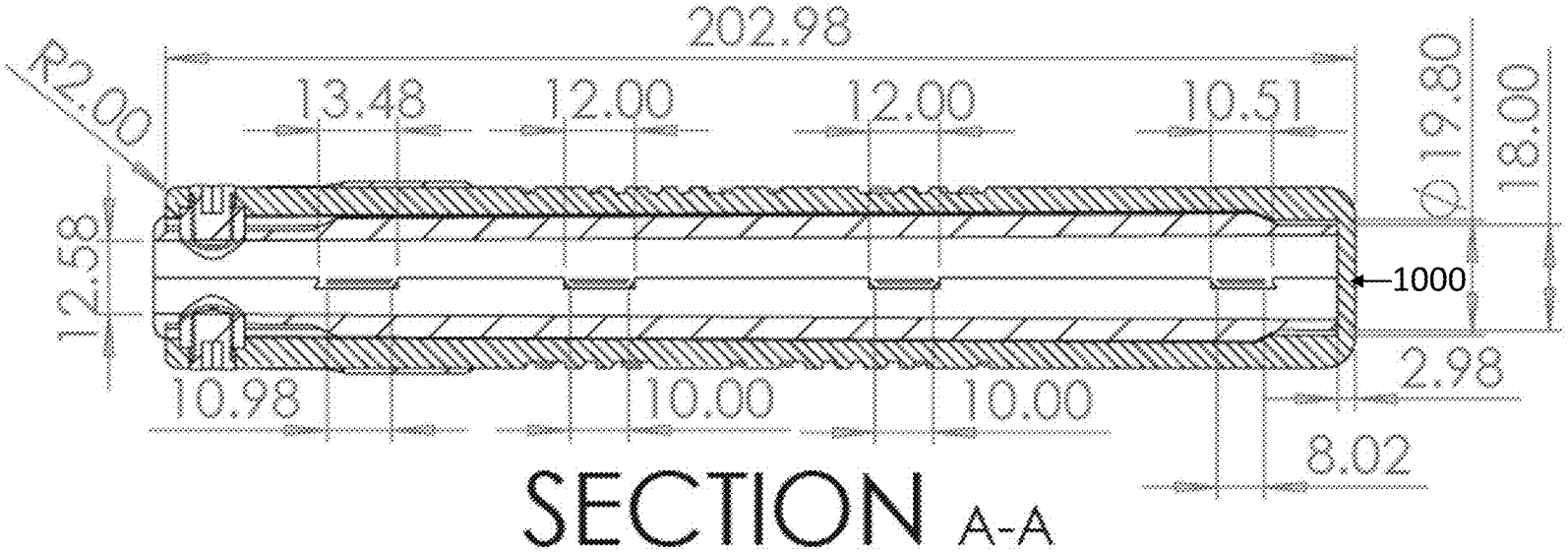
FIG. 10 is a cross-sectional view of the interchangeable golf club grip assembly in FIG. 5 in accordance with embodiments of the present invention.

With reference to FIGS. 5-10 (in combination with FIG. 1) shows another embodiment of an interchangeable golf club grip assembly 500 employed with a golf club 102 having a shaft 106 having a first end 110 and a second end 112 opposing the first end 110 and with a club head 108 disposed thereon. Specifically, the interchangeable golf club grip assembly 500 includes a inner sleeve member 502 (that may be cylindrical or another oblong shape) with a first end 508 defining a first end opening 600, with a second end 510 opposing the first end 508 of the inner sleeve member 502 and defining a second end opening 512, and an inner sleeve length separating the first and second ends 508, 510 of the inner sleeve member 502. The outer sleeve member 504 may also be cylindrical and have a first end 538 defining a first end opening 1000, a second end 540 opposing the first end 538 of the outer sleeve member 504 and defining a second end opening 542, and with an outer sleeve length separating the first and second ends 538, 540 of the outer sleeve member 502. Exemplary and preferred dimensions and lengths are depicted in FIG. 10. The lengths of the inner and outer sleeve members 502, 504 are specifically designed and configured to replace the typical and conventional grips utilized by golf clubs.

The inner sleeve member 502 includes an outer surface 506 having a plurality of ribs 518*a-n* (wherein "n" represents any number greater than one) oriented longitudinally along the inner sleeve length, disposed in a circumferential offset configuration with respect to one another (as shown in the figures), and extending radially outward from the outer surface 506 of the inner sleeve member 502. The plurality of ribs 518*a-n* may extend the entire inner sleeve length, or preferably less than the entire inner sleeve length to provide adequate spacing for one or more fastener(s) utilized to couple the sleeve members 502, 504 together. In some embodiments, the plurality of ribs 518*a-n* may discontinuously span the inner sleeve length, i.e., have gaps disposed therein. The plurality of ribs 518*a-n* are formed integrally with the inner sleeve member 502 to provide a substantially rigid and durable piece of material sufficient to withstand torsions experienced thereon. To that end, the inner and outer sleeve members 502, 504 may be of a lightweight polymeric material such as HDPE.

The inner sleeve member 502 includes an inner surface 514 defining an inner channel 516 substantially spanning the sleeve length, spatially coupling the first end opening 600 and the second end opening 512, and is sized and shaped to have the shaft 106 disposed therein. In one embodiment, the user will remove the conventional or original grip material from the shaft 106 and place the inner sleeve member 502 completely or partially around the shaft. In one embodiment, the inner sleeve member 502 includes two shells 610, 612 each having a portion of one of the plurality of rib members 518*a-b* directly coupled together to surround the shaft 106 of the golf club 102 to defining two joints 520, 522 spanning the inner sleeve length and the outer sleeve length. Specifically, the user will place one of the two shells 610, 612 around the shaft to align one of the ribs and a threaded internal wall 526 outwardly such that one of the ribs is longitudinally oriented in a direction with the club head 108. Said another way, the rib on one of the two shells 610, 612 is substantially parallel and/or co-planar with the club head 108, such that the threaded internal wall 526 is facing or oriented approximately 90° with respect to the orientation of the club head 108. This alignment ensures the grip material 530 disposed on the outer sleeve member 504 is oriented in the correct position and the user's grip will not be interfered with while utilizing the club 102.

In one embodiment, the one of the two shells 610, 612 is adhered or affixed to the shaft using adhesive or another chemical or mechanical means, e.g., welding. Said another way, the shaft 106 of the club 102 may be adhesively retained by the inner surface 514 of the inner sleeve member 502. Once aligned, the two shells 610, 612 may be directly coupled and retained together with a plurality clip fasteners 804*a-n* (shown best in FIGS. 8-9) that prevent easy lateral separation.

The outer sleeve member 504 includes an outer surface 528 formed by at least a portion with a deformable material 530 (e.g., TPR, natural rubber, or a material conventionally used for golf club grips) for gripping by a user and circumferentially disposed thereon. In one embodiment, the deformable material 530 completely surrounds the outer surface 528 and may include one or more portions (e.g., portion 700 in FIG. 7) for advertising the brand of the assembly. The outer sleeve member 504 also includes an inner surface 532 opposing the outer surface 528 and defining an inner retention channel 534 and a plurality of rib recesses 536*a-n* oriented longitudinally along the outer sleeve length, disposed in a circumferential offset configuration with respect to one another, extending radially inward from the inner surface 532 of the outer sleeve member 502 defining the inner retention channel 534. In one embodiment, the plurality of rib recesses 536*a-n* are symmetrically disposed and configured with respect the plurality of ribs 518*a-n*. As seen in the figures, the plurality of rib recesses 536*a-n* are shaped and sized with respect to the plurality of ribs 518*a-n* such that the plurality of ribs 518*a-n* are each respectively disposed therein in a tightly-spaced configuration, i.e., the thickness and radial length of each of the plurality of ribs 518*a-n* is equal to or slightly less than (within approximately 3 mm) the thickness and length of the plurality of rib recesses 536*a-n*. Said differently, the plurality of rib recesses 536*a-n* are shaped and sized with respect to the plurality of ribs 518*a-n* such that the plurality of ribs 518*a-n* fit snuggly within the plurality of recesses 536*a-n*.

The outer sleeve member 504 also includes a threaded internal wall 544 having one or more locking fastener(s) 604, 606 (e.g., an Allen head screw) threadedly engaged and selectively removable with the threaded internal walls 526, 544 of both the inner sleeve member 502 and the outer sleeve member 504. Preferably, the head of the fasteners 604, 604 are recessed within the outer sleeve member 504 to reduce interference with the gripping by the user. In one embodiment, the threaded internal walls 544, 608 are integrally formed on the outer sleeve member 504 and disposed proximal to the second end 540. In other embodiments, the threaded internal walls 544, 608 are formed one the outer sleeve member 504 and disposed in other locations, e.g., at the first end 538. Additionally, more than two threaded internal walls 544, 608 may be utilized to lock the inner and outer sleeve members 502, 504 together.

The cylindrical outer sleeve member 504 is operably configured to be selectively, removably, slidably, and lockably coupled to the cylindrical inner sleeve member 502.

Said another way, the outer sleeve member 504 is operable to slide (e.g., using the ribs 518*a-n* and recesses 536*a-n* as a guide) over the inner sleeve member 502 that is fastened to the shaft 106. The outer sleeve member 504 is configured to be locked (both laterally and longitudinally) with respect to the inner sleeve member 502 using the ribs 518*a-n* and walls forming the recesses 536*a-n* and the one or more fastener(s) 526, 604.

Figure 6:
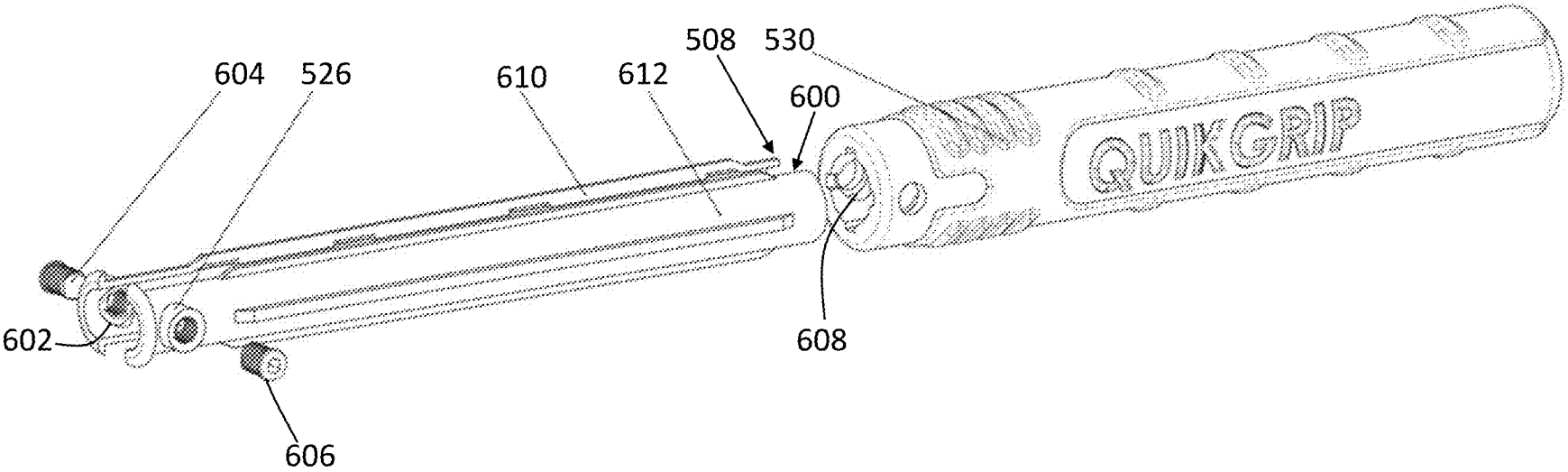
FIG. 6 is a perspective view of the inner sleeve member and the outer sleeve member in FIG. 5 in accordance with one embodiment of the present invention.
Figure 7:
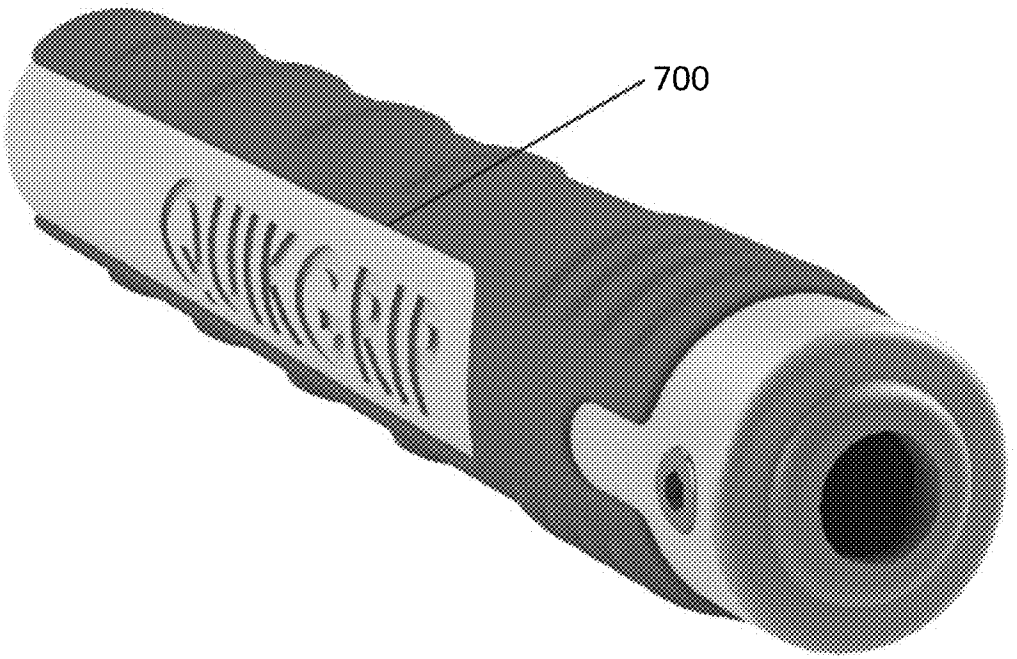
FIG. 7 is a perspective view of the interchangeable golf club grip assembly in FIG. 5 in accordance with one embodiment of the present invention.
Figure 9:
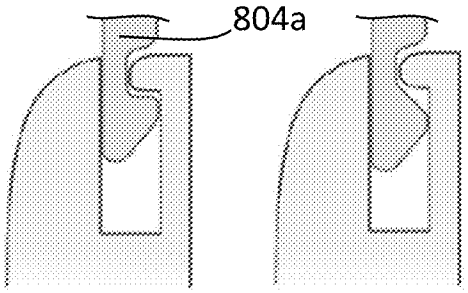
FIG. 9 are close-up views of fastening clips and portions of the inner sleeve member in accordance with embodiments of the present invention.
Figure 8:
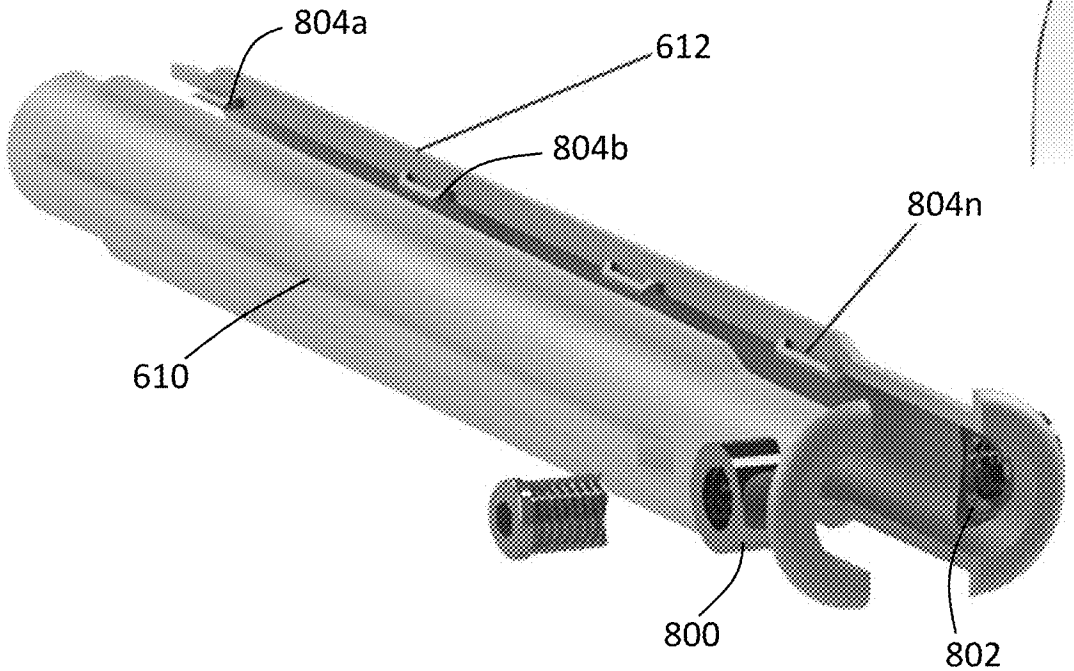
FIG. 8 is an exploded view of the inner sleeve member in FIG. 5 in accordance with one embodiment of the present invention.

In one embodiment, the plurality of ribs 518*a-n* continuously span along greater than 50% of the inner sleeve length (best seen in FIG. 6 and FIG. 10). Furthermore, a flange 524 may be beneficially disposed at the second end 510 thereon and defining an inner flange diameter greater than a diameter of the second end opening 542 (as best seen in FIG. 10), thereby preventing the outer sleeve member 504 from moving longitudinally passed a particular point.

In one embodiment, the inner sleeve member 502 has two independent threaded internal walls 526, 602 (that may be defined by metallic (e.g., bronze or copper) inserts) disposed on opposing sides of the inner sleeve member 502. Specifically, two attachment apertures may be defined on the inner sleeve member 502 and have two metallic inserts 800, 802 each respectively disposed within one of the two attachment apertures, wherein the two metallic inserts 800, 802 define the two independent threaded internal walls 526, 602. Furthermore, two threaded internal walls 544, 608 may be disposed on opposing sides of the outer sleeve member 504 and have two locking fasteners 604, 606 each respectively threadedly engaged with the threaded internal walls 526, 602, 544, 608 of both the inner sleeve member 502 and the outer sleeve member 504.

Although a specific order of executing the process steps of using and installing the interchangeable golf club grip assembly has been disclosed and depicted, the order of executing the steps may be changed relative to the order shown in certain embodiments. Also, two or more steps shown or described as occurring in succession may be executed concurrently or with partial concurrence in some embodiments. Certain steps may also be omitted for the sake of brevity. In some embodiments, some or all of the process steps can be combined into a single process.

Also, various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. In combination with a golf club having a shaft having a first end and a second end opposing the first end and with a club head disposed thereon, an improvement comprising:

an interchangeable golf club grip assembly having:

a cylindrical inner sleeve member with a first end defining a first end opening, with a second end opposing the first end of the inner sleeve member and defining a second end opening, with an inner sleeve length separating the first and second ends of the inner sleeve member, with an outer surface having a plurality of ribs oriented longitudinally along the inner sleeve length, disposed in a circumferential offset configuration with respect to one another, and extending radially outward from the outer surface of the inner sleeve member, with an inner surface defining an inner channel substantially spanning the sleeve length, spatially coupling the first end opening and the second end opening, and with the shaft of the disposed therein and adhesively retained by the inner surface of the inner sleeve member, and having a threaded internal wall;

a cylindrical outer sleeve member with a first end defining a first end opening, with a second end opposing the first end of the outer sleeve member and defining a second end opening, with an outer sleeve length separating the first and second ends of the outer sleeve member, with an outer surface formed by at least a portion with a deformable material for gripping by a user and circumferentially disposed thereon and with an inner surface opposing the outer surface and defining an inner retention channel and a plurality of rib recesses oriented longitudinally along the outer sleeve length, disposed in a circumferential offset configuration with respect to one another, extending radially inward from the inner surface of the outer sleeve member defining the inner retention channel, and with the plurality of ribs each respectively disposed therein in a tightly-spaced configuration that is within 3 mm in thickness variance of one another, and with a threaded internal wall defined thereon; and a locking fastener operably configured to threadedly selectively engage with the threaded internal walls of both the inner sleeve member and the outer sleeve member to prevent longitudinal movement of the outer sleeve member with respect to the inner sleeve member and operably configured to selectively disengage with threaded internal wall of the cylindrical inner sleeve member to selectively and longitudinally remove the outer sleeve member with respect to the inner sleeve member.

2. The improvement according to claim 1, wherein:

the plurality of ribs continuously span along greater than 50% of the inner sleeve length.

3. The improvement according to claim 1, wherein the inner sleeve member further comprises:

two shells each having a portion of one of the plurality of rib members directly coupled together to surround the shaft of the golf club to defining two joints spanning the inner sleeve length and the outer sleeve length.

4. The improvement according to claim 3, wherein:

the two shells are directly coupled and retained together with a plurality clip fasteners.

5. The improvement according to claim 1, wherein the inner sleeve member further comprises:

a flange disposed at the second end thereon and defining an inner flange diameter greater than a diameter of the second end opening.

6. The improvement according to claim 1, wherein the inner sleeve member further comprises:

two independent threaded internal walls disposed on opposing sides of the inner sleeve member.

7. The improvement according to claim 6, further comprising:

two attachment apertures defined on the inner sleeve member and with two metallic inserts each respectively disposed within one of the two attachment apertures, the two metallic inserts defining the two independent threaded internal walls; and two threaded internal walls disposed on opposing sides of the outer sleeve member and having two locking fasteners each respectively threadedly engaged with the threaded internal walls of both the inner sleeve member and the outer sleeve member.

8. An interchangeable golf club grip assembly comprising:

a cylindrical inner sleeve member with ad first end defining a first end opening, with a second end opposing the first end of the inner sleeve member and defining a second end opening, with an inner sleeve length separating the first and second ends of the inner sleeve member, with an outer surface having a plurality of ribs oriented longitudinally along the inner sleeve length, disposed in a circumferential offset configuration with respect to one another, and extending radially outward from the outer surface of the inner sleeve member, with an inner surface defining an inner channel substantially spanning the sleeve length, spatially coupling the first end opening and the second end opening, and having a threaded internal wall; and a cylindrical outer sleeve member with a first end defining a first end opening, with a second end opposing the first end of the outer sleeve member and defining a second end opening, with an outer sleeve length separating the first and second ends of the outer sleeve member, with an outer surface formed by at least a portion with a deformable material for gripping by a user and circumferentially disposed thereon and with an inner surface opposing the outer surface and defining an inner retention channel and a plurality of rib recesses oriented longitudinally along the outer sleeve length, disposed in a circumferential offset configuration with respect to one another, extending radially inward from the inner surface of the outer sleeve member defining the inner retention channel, and with the plurality of ribs sized and shaped to be received within the plurality of rib recesses in a tightly-spaced configuration that is within 3 mm in thickness variance of one another, and with a threaded internal wall having a locking fastener operably configured to be threadedly engaged to prevent longitudinal movement of the outer sleeve member with respect to the inner sleeve member and selectively removable with the threaded internal walls of both the inner sleeve member and the outer sleeve member, the cylindrical outer sleeve member operably configured to be selectively, removably, slidably, and lockably coupled to the cylindrical inner sleeve member with the locking fastener.

9. The interchangeable golf club grip assembly according to claim 8, wherein:

the plurality of ribs continuously span along greater than 50% of the inner sleeve length.

10. The interchangeable golf club grip assembly according to claim 8, wherein the inner sleeve member further comprises:

two shells each having a portion of one of the plurality of rib members directly coupled together to surround the shaft of the golf club to defining two joints spanning the inner sleeve length and the outer sleeve length.

11. The improvement according to claim 10, wherein:

the two shells are directly coupled and retained together with a plurality clip fasteners.

12. The interchangeable golf club grip assembly according to claim 8, wherein the inner sleeve member further comprises:

a flange disposed at the second end thereon and defining an inner flange diameter greater than a diameter of the second end opening.

13. The improvement according to claim 8, wherein the inner sleeve member further comprises:

two independent threaded internal walls disposed on opposing sides of the inner sleeve member.

14. The improvement according to claim 13, further comprising:

two attachment apertures defined on the inner sleeve member and with two metallic inserts each respectively disposed within one of the two attachment apertures, the two metallic inserts defining the two independent threaded internal walls; and two threaded internal walls disposed on opposing sides of the outer sleeve member and having two locking fasteners each respectively threadedly engaged with the threaded internal walls of both the inner sleeve member and the outer sleeve member.

* * * * *